US006698034B1

(12) United States Patent
Landesberg et al.

(10) Patent No.: US 6,698,034 B1
(45) Date of Patent: Mar. 2, 2004

(54) TOILET RIM DISPENSER FOR COLORED LIQUID

(75) Inventors: Alexander Landesberg, Herzeliya (IL); Marc Bremaeker, Givat Ela (IL)

(73) Assignee: San Bruno's Enterprises Ltd., Hod Hasharon (IL)

( * ) Notice: Subject to any disclaimer, the term of this patent is extended or adjusted under 35 U.S.C. 154(b) by 0 days.

(21) Appl. No.: 10/330,185

(22) Filed: Dec. 30, 2002

(30) Foreign Application Priority Data

Aug. 15, 2002 (IL) ..... 151273

(51) Int. Cl.[7] ..... E03D 9/02
(52) U.S. Cl. ..... 4/223; 4/231
(58) Field of Search ..... 4/223, 225.1, 226.1, 4/227.5, 227.6, 231

(56) References Cited

U.S. PATENT DOCUMENTS 2,839,763 A * 6/1958 Newsom ..... 4/227.5
4,916,760 A * 4/1990 Shahar ..... 4/227.5

FOREIGN PATENT DOCUMENTS

| | | |
|---|---|---|
| EP | 0 538 957 B1 | 3/1996 |
| EP | 0 785 315 B1 | 6/2000 |
| IL | 85410 | 11/1988 |

* cited by examiner

*Primary Examiner*—Robert M. Fetsuga
(74) *Attorney, Agent, or Firm*—Oliff & Berridge, PLC

(57) ABSTRACT

A liquid rim dispenser intended for suspension from a rim of a toilet bowl adjacent a wall thereof, in the path of flushing water during a flushing operation, comprises a basin with a basin wall and a basin bottom having a bottom opening and a cup with a cup wall and a cup bottom fixed within said basin. The dispenser further comprises a container with a colored staining liquid having a discharge opening facing the bottom of the cup with a predetermined clearance therebetween. The dispenser is so configured that the discharge opening is lower than the cup wall, and the bottom opening is lower than the cup wall and is located remote from the wall of the toilet bowl, and at least when the dispenser is suspended from the bowl rim, the bottom opening is higher than a low portion of the basin bottom.

13 Claims, 2 Drawing Sheets

TOILET RIM DISPENSER FOR COLORED LIQUID

FIELD OF THE INVENTION

This invention relates to liquid rim dispensers to be suspended from the rim of a toilet bowl in the path of flushing water during a flushing operation of the toilet, and including a bottle containing a lavatory freshner/cleaner liquid a quantity of which is delivered to the toilet during a flushing operation.

BACKGROUND OF THE INVENTION

A liquid rim dispenser of the above mentioned type is, for example, sold under the trade name Toilet Duck by Johnson Wax. The dispenser comprises a carrier with an upwardly extending tubular puncturing member with a bottom aperture and a fan-shaped plate with radially extending grooves whose innermost portions underlie the aperture. A bottle of liquid composition with a sealing cap is applied on the carrier so that the puncturing member pierces the cap and the liquid drains onto the carrier below. A predetermined volume of liquid composition is held by way of capillary action on the grooves for entrainment into a toilet during a flushing operation. The liquid rim dispenser is necessarily required to be more or less upright for containment of liquid composition in the grooves, however, since such a disposition can be easily upset by the action of flushing water, the liquid rim dispenser is susceptible to leakage therefrom. If the liquid composition is colored, the blue color being most often preferred, a streak or drops leave unpleasant stains on the wall of the toilet bowl.

A liquid rim dispenser is manufactured by Sano, Israel (Patent Application No. 134160) where a bottle with colored liquid composition is disposed in a toppled position over a carrier in a similar manner to the Toilet Duck described above. However, the Sano dispenser provides a cup under the bottle opening, the cup walls being higher than the opening. Thereby, a limited portion of concentrated colored liquid drained in the cup above the level of the bottle opening is always ready to be mixed with the flushing water. The cup is surrounded by a slotted wall conductive to the vigorous mixing of the colored composition with the flushing water.

Other liquid rim dispensers are disclosed, for example, in EP 0538957 and EP 0785315, in which a quantity of liquid composition is washed out from a porous mass made of sponge or sintered porous material during a flushing operation.

A toilet dispenser of a different type, disclosed in IL 85410 and directed to delivering colored solution to the toilet bowl, is designed for using a solid preparation dissolvable by the flushing water. It comprises a holder for the solid colored substance and a bath under the holder, the bath having two openings slightly extended by tubing so that the colored solution drops far from the bowl wall.

SUMMARY OF THE INVENTION

In accordance with the present invention, there is provided a liquid rim dispenser intended for suspension from a rim of a toilet bowl adjacent a wall thereof, in the path of flushing water during a flushing operation. The liquid rim dispenser comprises a basin with a basin wall and a basin bottom having a bottom opening, a cup with a cup wall and a cup bottom fixed within the basin, and a container with a colored staining liquid. The container has a discharge opening facing the bottom of the cup with a predetermined clearance therebetween. The dispenser is so configured that the discharge opening is lower than the cup wall, the bottom opening is lower than the cup wall and is located remote from the wall of the toilet bowl, and the bottom opening is higher than the lowest portion of the basin bottom, at least when the dispenser is suspended from the bowl rim.

The dispenser operates in the following way: the colored liquid seeps into the cup forming a first pool, and the discharge opening, which is the only access for air into the container, becomes submerged in the first pool. During a first flushing operation, the flushing water entrains the colored liquid from the first pool therewith into the toilet, spilling over the basin wall. A last portion of the flushing water is retained in the basin below the basin wall and is gradually drained from the dispenser through the bottom opening, dropping clear from the wall of the toiled bowl. A second pool of diluted color liquid is formed in the low portion of the basin bottom ready to be entrained with the flow of flushing water in a next flushing operation. This process is repeated until the container is empty.

The liquid rim dispenser preferably comprises two bottom openings disposed in a line generally parallel to the rim of the toilet bowl. The openings are preferably formed as drainage tubes extended beneath the bottom of the basin and curved so as to convey the dropping last portion of the flushing water farther from the wall of the toilet bowl. The drainage tubes may be also elevated above the bottom of the basin, thereby defining the low portion of the basin bottom.

The cup bottom is preferably elevated from the basin bottom, at least about the level of the drainage tubes' inlets.

The wall of the basin and the wall of the cup are preferably complemented with a plurality of baffles and openings or slits therebetween so as to restrain the flow of flushing water and delay the entraining of the colored liquid into the toilet bowl.

In a preferred embodiment of the present invention, the liquid rim dispenser consists of a holder including said basin and a rim handle, and a separate container in the form of a replaceable bottle. The holder is preferably molded as one piece of material. The opening of the replaceable bottle is preferably covered by a puncturable cap which is punctured by a blade integral with the cup bottom in the moment when a new bottle is replaced in the holder.

The present invention uses the well known physical phenomenon that atmospheric pressure acting on a surface area of a pool of liquid can support a column of liquid within an inverted vessel whose open end is submerged in the pool of liquid. The volume of the pool of liquid which accumulates in the cup is dependent on its height which in turn is dependent on a number of factors including the annular surface area of the pool, the viscosity of the liquid composition, its surface tension, and others. The liquid rim dispenser of the present invention can be readily adapted for use with a wide variety of liquid compositions having a viscosity within the range of 50 and 3,000 centipoises at 25° C. to meet different criteria in terms of color, foam forming, odor release, desired number of flushing operations per bottle, and other considerations.

The liquid rim dispenser of the present invention promotes effective dilution of the colored liquid in the flushing water by preparing at each flushing a pool of diluted liquid ready for washing away with the next flushing. The inventive liquid dispenser delays the draining of the basin towards the end of the flushing operation thereby preventing the waste of colored liquid with the first portions of flushing water which always go down the sewer. This is beneficial to the overall freshening and cleaning action of the liquid composition. Moreover, the bottom openings in the basin of the present dispenser are specially designed to avoid staining of the toilet bowl wall by the last drops of relatively concentrated colored liquid draining from the basin.

DETAILED DESCRIPTION OF THE DRAWINGS

In order to understand the invention and to see how it may be carried out in practice, a preferred embodiment will now be described, by way of a non-limiting example only, with reference to the accompanying drawings, in which.

DETAILED DESCRIPTION OF A PREFERRED EMBODIMENT

Figure 1:
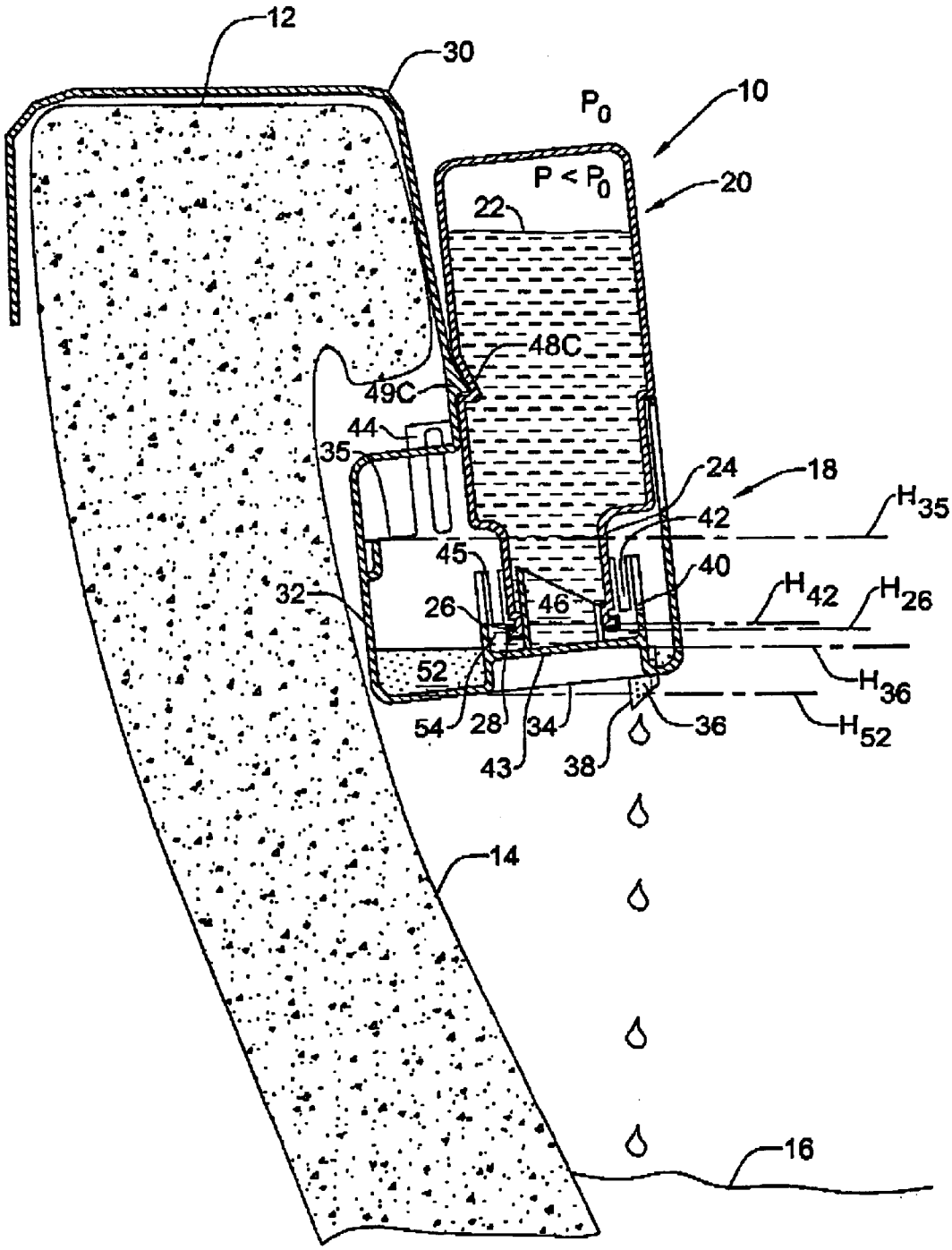
FIG. 1 is a side sectional elevation of the liquid rim dispenser of the present invention in operative position suspended on the rim of a toilet bowl.
Figure 2:
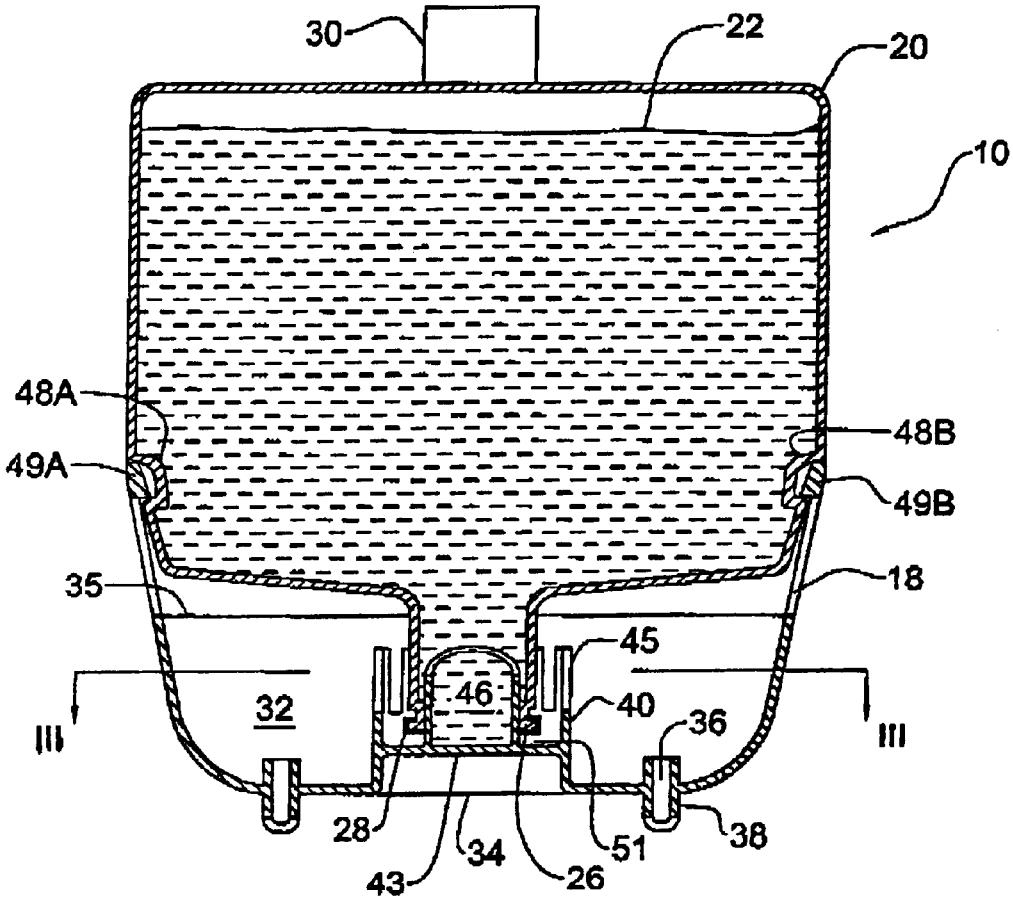
FIG. 2 is a frontal section of the liquid rim dispenser along line II—II in FIG. 3.
Figure 3:
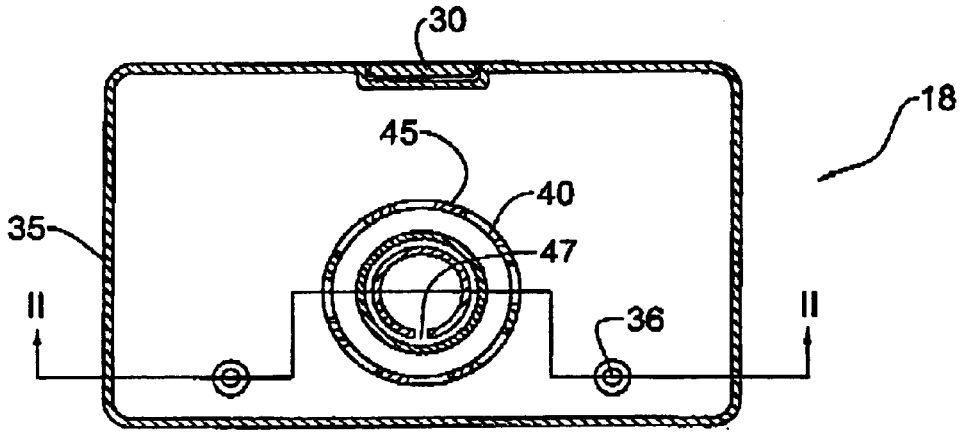
FIG. 3 is a horizontal section of the liquid rim dispenser along line III—III in FIG. 2.

With reference now to the Figures, there is shown a liquid rim dispenser 10 of the present invention, in use, i.e. suspended from a rim 12 of a toilet bowl adjacent a wall 14 thereof, so as to be located in the path of flushing water during a flushing operation of the toilet and above the surface of water 16 normally retained in the toilet bowl.

The liquid rim dispenser 10 includes a holder 18 of unitary construction, and a replacement bottle 20 detachably connectable to the holder 18 and containing a colored liquid 22 with active ingredients for cleaning and freshening a toilet. The bottle 20 has an elongated neck 24 terminating in a rim 26 defining a discharge opening initially sealed by a cap 28 snap-fitted onto the rim 26.

The unitary holder 18 includes a suspension hook 30 for suspending the dispenser 10 from the rim 12 of a toilet bowl, and a basin 32 with a basin bottom 34 and basin wall with upper rim 35. The basin 32 has two bottom openings 36 formed with tubular nipples 38, remote from the toilet bowl rim. The basin wall has upward extending baffles 44 with slits therebetween. A cup 40 with a cup rim 42 and cup bottom 43 is formed within the basin 32, elevated above the basin bottom 34. The cup also has upward extending baffles 45 with slits therebetween. At the cup bottom 43, there is an upwardly extending tubular blade 46 for puncturing the cap 28 on insertion of the bottle 20 into the holder 18. The blade has a discharge slit 47.

The bottle 20 is snapped and held in fixed position by three recesses 48A, 48B, 48C cooperating with three matching protrusions 49A, 49B, 49C on the holder 18. In the fixed position, the bottle 20 is toppled over the cup 40 with the rim 26 within the cup 40, and the discharge opening of the bottle has a predetermined clearance 51 above the cup bottom 43.

The dispenser 10 is configured so that the rim of the bottle discharge opening 26, at height $H_{26}$, is lower than the cup rim 42 at height $H_{42}$, and the bottom openings 36, at height $H_{36}$, are lower than the cup rim 42. The openings 36 are normally located over the surface of water 16 in the bowl. There is a part 52 of the basin bottom 34 still lower than the bottom openings 36, at height $H_{52}$. The basin 32 can be filled up to the height $H_{35}$ of the upper rim 35. It should be understood that the dispenser is most likely to assume a slightly inclined position, as for example shown in FIG. 1, and the above mentioned heights then refer to the lowest points of the rims 35 and 42, the lower of the openings 36, and the highest point of the rim 26.

Due to this configuration, the colored liquid 22 from the bottle 20 seeps into the cup 40 through the discharge slit 47 and the clearance 51 to form a first pool 54. Since the discharge opening of the bottle is entirely submerged in the pool 54 and there is no other access for air into the bottle 20, the pressure P above the free surface of the colored liquid 22 in the bottle falls under the atmospheric pressure $P_0$ with the seeping of the liquid. Thus, the created vacuum allows pouring of a portion of the liquid only.

The use and the operation of the liquid rim dispenser 10 is as follows:

The bottle 20 is inserted into the holder 18 whereby the blade 46 punctures the bottle's cap 28 and the colored liquid drains into the cup 40 and floods the bottle's discharge opening in the pool 54 of liquid accumulated in the cup. The dispenser 10 is suspended from the rim 12 of a toilet bowl, in the path of the flushing water. During a flushing operation, the flushing water flows past the baffles 44 into the basin 32 where it vigorously mixes with a color liquid solution resident in the lower part 52 of the basin from a previous flushing operation. The flushing water also mixes with the concentrated color liquid pool 54 in the cup 40, penetrating past baffles 45, and fills the basin 32 up to the height $H_{35}$ before flowing therefrom into the toilet. Due to the turbulent flow of the flushing water through the basin, air bubbles enter into the discharge opening of the bottle 20, restoring the atmospheric pressure $P=P_0$ above the free surface of the colored liquid in the bottle whereby the bottle is ready to deliver the next portion of colored liquid to the cup 40.

The baffles 44 and 45 over the basin wall 35 and the cup wall 42 limit the free flow of flushing water through the basin and delay its flooding, while the relatively narrow bottom openings 36 do not let the flooded basin to drain immediately. As a result, the basin 32 remains almost full of diluted colored liquid by the end of the flushing operation. Then the solution is gradually discharged through the bottom openings 36, until the bottle 20 administers a new portion of colored liquid into the cup 40, and the level of solution in the basin falls to the lower of the openings 36, leaving a second pool in the part 52 ready for the next flushing. The process is repeated until the bottle 20 is empty.

Since, first, the last portions of colored liquid that drop from the openings 36 are not concentrated but diluted, and second, the openings 36 are disposed far from the bowl wall 14, staining of the bowl wall with concentrated colored liquid is reduced or avoided altogether. At the same time, due to the limited and delayed access of the flushing water to the dispenser, the colored liquid is not uselessly flushed into the toilet but is delivered to the water surface 16 after the flushing.

It should be understood that, between the flushing operations, the portion of concentrated liquid in the first pool 54 must be separated from the liquid solution in the second pool 52 to avoid diluting of the liquid in the bottle by diffusion. Also, it is desirable to keep the cup 40 wide open for easier flushing and mixing. Given that the volume of the pool 54 should be limited to an optimal quantity of concentrated color liquid per flushing operation, the cup 40 is preferably designed to be relatively wide and shallow, i.e. the cup rim 42 to be relatively low. But then there is a chance that the pools 54 and 52 may communicate with each other, especially if the dispenser assumes a more inclined position. To warrant the separation of pools 54 and 52 for a wider range of suspension angles, and thus the operability for varying shapes of toilet bowls, the cup bottom 43 is preferably not flush with the basin bottom 34 but is rather elevated above the latter, at least to about the height of the bottom openings 36.

While the invention has been described with respect to a limited number of embodiments, it will be appreciated that many variations, modifications and other applications of the invention can be made which fall within the scope of the claims appended hereto. For example, the liquid rim dispenser of the present invention can be formed with one bottom opening, the bottom openings may be formed with an extended downward outlet or with elevated inlet, the cup may be formed without the puncturing blade.

What is claimed is:

1. A liquid rim dispenser intended for suspension from a rim of a toilet bowl adjacent a wall thereof, in the path of flushing water during a flushing operation, said liquid rim dispenser comprising a basin with a basin wall and a basin bottom having a bottom opening, a cup with a cup wall and a cup bottom fixed within said basin, a container with a colored staining liquid having a discharge opening facing the bottom of said cup with a predetermined clearance therebetween, said dispenser being so configured that said discharge opening is lower than the cup wall, said bottom opening is lower than the cup wall and is located remote from said wall of the toilet bowl, and at least when the dispenser is suspended from the bowl rim, said bottom opening is higher than a low portion of the basin bottom, the dispenser operating in the following way:

said colored liquid seeps into said cup forming a first pool, said discharge opening being submerged in said first pool;

during a first flushing operation, the flushing water entrains the colored liquid from said first pool therewith into the toilet, over said basin wall;

a last portion of the flushing water is retained in said basin below said basin wall and is drained from the dispenser through said bottom opening, dropping remote from the wall of said toiled bowl;

a second pool of diluted color liquid is formed in said low portion of the basin bottom ready to be entrained with the flow of flushing water in a next flushing operation.

2. A liquid rim dispenser according to claim 1, further comprising a second bottom opening, the two openings being disposed in a line generally parallel to the rim of the toilet bowl.

3. A liquid rim dispenser according to claim 1, wherein said bottom opening is formed as a drainage tube with an inlet in said basin and an outlet beneath the bottom of said basin.

4. A liquid rim dispenser according to claim 3, wherein the inlet of said drainage tube is elevated above the bottom of the basin, thereby defining said low portion of the basin bottom.

5. A liquid rim dispenser according to claim 3, wherein the outlet of said drainage tube is extended and/or curved so as to convey said last portion of the flushing water farther from said wall of the toilet bowl.

6. A liquid rim dispenser according to claim 3, wherein said cup bottom is elevated above said inlet of said drainage tube.

7. A liquid rim dispenser according to claim 1, wherein said cup bottom is elevated above said basin bottom.

8. A liquid rim dispenser according to claim 1, wherein said basin wall is complemented with a plurality of baffles and openings therebetween.

9. A liquid rim dispenser according to claim 1, wherein said cup wall is complemented with a plurality of baffles and openings therebetween.

10. A liquid rim dispenser according to claim 1, wherein said dispenser consists of a holder including said basin and a separate container in the form of a replaceable bottle.

11. A liquid rim dispenser according to claim 10, wherein said holder constitutes one piece of material.

12. A liquid rim dispenser according to claim 10, wherein said holder comprises a puncturing blade extending from said cup bottom and the discharge opening of said bottle is covered by a puncturable cap.

13. A liquid rim dispenser according to claim 12, wherein said puncturing blade is of tubular shape and has at least one slit extending to said cup bottom.

* * * * *

UNITED STATES PATENT AND TRADEMARK OFFICE

CERTIFICATE OF CORRECTION

PATENT NO. : 6,698,034 B1 
DATED : December 30, 2002
INVENTOR(S) : Alexander Landesberg et al.

It is certified that error appears in the above-identified patent and that said Letters Patent is hereby corrected as shown below:

Title page,
Item [73], Assignee, should read as follows:

-- [73] Assignee: Sano Bruno's Enterprises Ltd., Hod Hasharon (IL) --

Signed and Sealed this

Twenty-ninth Day of June, 2004

JON W. DUDAS
*Acting Director of the United States Patent and Trademark Office*